United States Patent [19]

Hansard et al.

[11] 4,333,563

[45] Jun. 8, 1982

[54] FILM OR TAPE RETAINER DEVICE FOR REELS

[76] Inventors: Robert C. Hansard, 6711 Varna Ave., Van Nuys, Calif. 91401; E. R. Brink, Jr., 922 Patterson Ave., Glendale, Calif. 91202

[21] Appl. No.: 193,347

[22] Filed: Oct. 2, 1980

[51] Int. Cl.[3] ..... B65D 85/67; B65D 85/671; B65D 63/10

[52] U.S. Cl. ..... 206/53; 206/400; 24/16 PB

[58] Field of Search ..... 206/53, 400; 24/16 PB, 24/17 B

[56] References Cited

U.S. PATENT DOCUMENTS

| | | | |
|---|---|---|---|
| 1,797,539 | 3/1931 | Arthur | 24/16 PB |
| 2,425,100 | 8/1947 | Kulka | 206/53 |
| 2,633,983 | 4/1953 | Miller | 206/400 |
| 3,195,722 | 7/1965 | Duden | 206/53 |
| 3,823,814 | 7/1974 | Lum | 24/17 B |
| 3,998,325 | 12/1976 | Kulka | 206/400 |

*Primary Examiner*—William T. Dixson, Jr.
*Attorney, Agent, or Firm*—Wagner & Bachand

[57] ABSTRACT

This device is a film retainer for reel stored film comprising of a closed loop of elastic mesh material which is relatively inelastic in a transverse direction and relatively elastic in a longitudinal direction, with the extension of the elastic material at least 50%. The mesh is open to the degree that at least 50% to aid in viewing all printed matter on the leader of the film. A tag, for use in placement and removal of the loop as well as for identification purposes, is secured at one end of the loop and is of sufficient length to extend beyond the edge of the reel when the retainer is placed on a roll of film on a reel.

6 Claims, 6 Drawing Figures

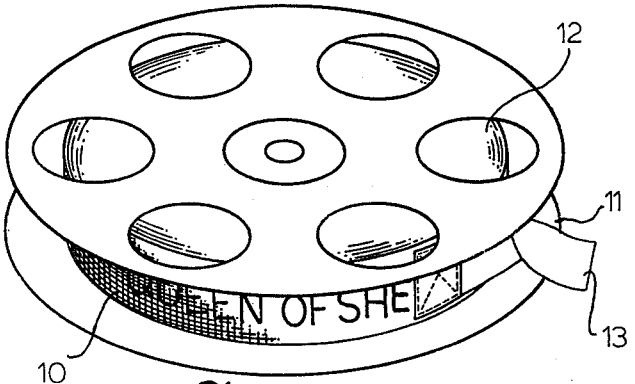
Fig. 3
PRIOR ART
Fig. 1
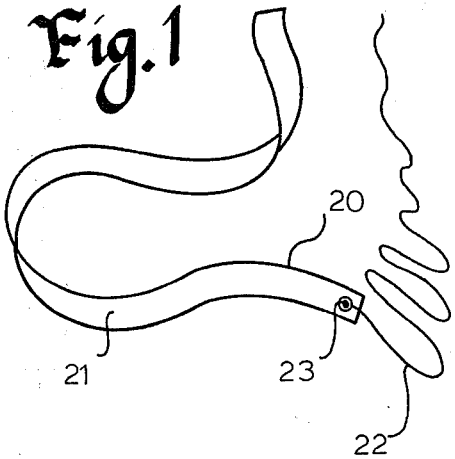
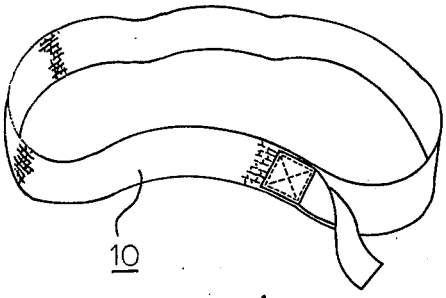
Fig. 4
PRIOR ART
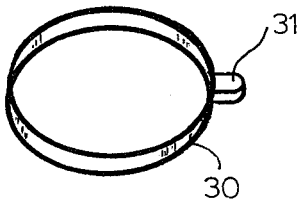
Fig. 2
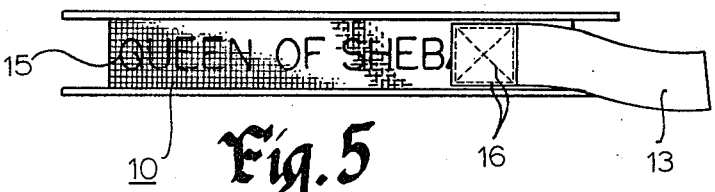
Fig. 5
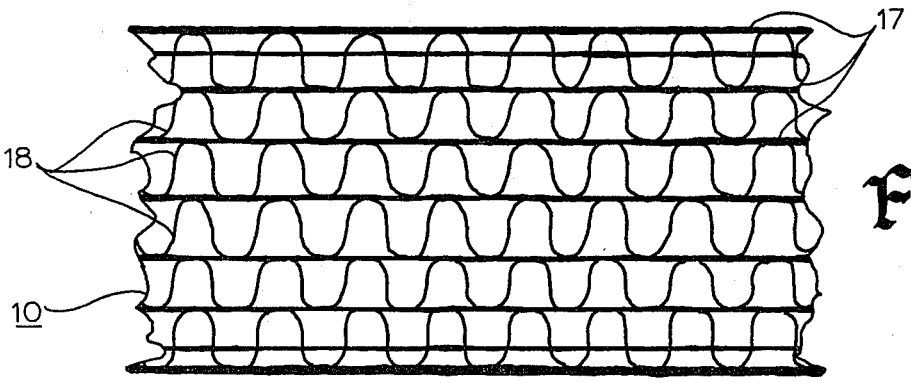
Fig. 6

FILM OR TAPE RETAINER DEVICE FOR REELS

BACKGROUND OF THE INVENTION

Today motion picture and film strips are used for entertainment, education and business purposes throughout the world. Such wide usage of films and the like is both a cause and result of the technical evolution of films, photography equipment and lighting fixtures. An outcome of this evolution is the high quality which is now seen in the finished film products.

Although most facets of the film industry were affected by this evolution one facet which was not concerns the progress of the apparatus used to secure film on a reel. Even in its infant stage the film industry used paper strips. These special paper strips were used by wrapping the paper around the film on a reel and securing the ends with a string which was then wound around the paper and fastened around a grommet paper tab. The disadvantages of this method are that the paper is subject to tearing, the string is subject to breaking, and the whole process is cumbersome. In addition, the paper conceals the name of the film on the leader thus requiring extra labor for labeling. The cost of the paper strip is minimal but considering the labor involved in labeling each strip and their single usage which is usually necessary the cost is more than anticipated.

An alternate form of film retainer is a rubber band type embodiment. This film retainer has a much lower rate of acceptability because the bands are only suitable for much smaller reels, they tend to crack and break with age, and they can cause physical distortion of the film due to the pressure exerted where rubber bands makes contact with the film.

A reel can is for use in transport and storage but also possibly for film retention on a reel. Disadvantages of the reel can are that they are heavy, expensive, and that they conceal the contents of the can when there is no edge labeling.

BRIEF STATEMENT OF THE INVENTION

We have developed a new and improved form of film retainer to be used in conjunction with reels of film. This device is a continuous loop made of open mesh elastic webbing with an attached tag. Using the tag, the device is easy to both put on and take off quickly without harming the film. The webbing used for this device is a open weave which allows the leader of the film with the name of the film printed on it to be readily seen and at the same time durable, self tensioning, easily folding for safe storage. The tag may also be labeled, thus it can serve a double function. This device is inexpensive to the buyer in that it can outlast the life of the rubber band and paper strip and eliminate the need for double labeling.

BRIEF DESCRIPTION OF THE DRAWINGS

FIG. 1 is an elevational view of a prior art device for film on a reel;

FIG. 2 is an elevational view of an alternate form of prior art film securing device;

FIG. 3 is a perspective view of our invention holding a film on a reel;

FIG. 4 is a perspective view of this invention separated from a reel;

FIG. 5 is an elevational side view of the invention on a reel, illustrating its transparency; and FIG. 6 is an enlarged fragmentary view of the preferred elastic material for use in this invention.

DETAILED DESCRIPTION OF THE DRAWINGS

Now referring to the drawing in which in FIGS. 1 and 2 two examples of the prior art of this invention are represented. In FIG. 1 a paper strip 20 is seen made up of a paper body 21 which is wrapped around a reel of film and a string 22 which is then wrapped around the paper strip 20 and secures the strip 20 in place when the string 22 is wrapped around a paper grommet button 23. The paper body 21 requires additional labor to label the strip 20 with all pertinent information on the film on which it is used. Another form of prior art is seen in FIG. 2 and is commonly referred to as a rubber band. The rubber band 30 consists of a thin circular band of extruded rubber with a tab 31. The band 30 is only used on small reels and usually only for film smaller than 35 mm.

The above types of securing devices have been used for over fifty years with venerable paper strip a common part of the film industry which has learned to live with its limitations.

We have taken another look at the process of film handling in connection with the day to day needs of the film distribution industry. We have found that, rather than an interrupted circle device such as a paper strip or a narrow elastic band, a broad open mesh elastic band with an end tab provides a far superior film securing device. Far fewer motions are required in placing the band of our invention on a film reel resulting in speedier film handling.

Now referring to FIG. 3 in which an elastic film retainer 10 of our invention is seen in place on a reel 11 with film 12 and comprises a closed loop 10 of elastic mesh having a width approximately equal to the film to be held. The mesh is inelastic in the transverse direction and exhibits approximately a 50% or greater expansion in its longitudinal direction. For use on a 15 cm diameter 35 mm reel, the retainer has a width of 38 mm and a free (unextended or stretched) length of 80 cm (31 in). The retainer 10 exhibits extension or ultimate stretch capability of up to 120 cm (47 in). Preferably, we use a material known as Nylon-Lycra knit elastic, style number 15010k, 1.5 inch width which is manufactured by the Rhode Island Textile Co. of Pawtucket, R.I. The retainer 10 is formed into a loop by sewing ends in overlapped relation with a tag 13 overlying the ends. Transverse filaments 17, seen in FIGS. 3, 5 and 6 are relatively inelastic and are preferably of Nylon and the longitudinal filaments 18 are of elastic Spandex. A cross stitch within a box is commonly used in sewing tabs to fabrics and effectively secures all three parts together for a reliable product.

The elastic mesh material shown preferably has an open area of at least 50% but preferably 75% of the total area of the retainer 10. This relationship insures that any labelling in the film leader shows clearly through the mesh and is readable. We have also found that a light color for the retainer 10 aids readability of the underlying leader label. By way of contrast, the tag may be color coded for easy selection of film reels, for ownership or other purposes and may be imprinted if desired.

In use, the retainer 10 is placed on the reel 11 by placing a small portion of the retainer 10 on the film 12 and elastic retainer 10 over the reel 11 and holding the attached tag 13 to stretch the elastic retainer 10 over the reel 11 until the retainer 10 surrounds the film snugly. The Nylon-Lycra elastic material used is found to be chemically stable thus it does not react with the film, an important characteristic when in such close contact with film. The open mesh allows all pertinent information printed on the film to be seen through the material which reduces the labor necessary to label the paper strip 20 seen in FIG. 1. The open mesh also prevents any mishaps due to mislabeling of the strip. As a double check for identification of the film, the tag 13 which hangs out as shown in FIG. 3, may also be labeled and is available in different colors so that color coding may be used to classify films if so desired.

Now referring to FIG. 4 in which an elastic reel retainer 10 is seen alone without a reel. The retainer 10 is made up of the elastic material. The general type of which has been in use since the early 1970's in conjunction with women's garters. This material has proven to be a strong and durable product. When removed from a reel as shown in FIG. 4, the retainer 10 naturally retracts to its minimum length and may be folded into a packet and stored for later use.

Now referring to FIG. 5 in which an enlarged view of the reel 11 and retainer 10 is seen with the visibility of the writing 15 on the film leader clearly evident. The weave of the open mesh is large enough for a clear view and in this case, the film label "Queen of Sheba" is clearly readable through the mesh. The mesh is approximately the width of the film so its contracting force acts in a distributed manner over the surface of the film in contrast to the rubber band or winding on a paper strip. This allows for the film to be snugly attached to the reel without bunching of the retainer 10. A clear view of the attachment of the tag 13 to the body of the retainer 10 may be seen in FIG. 5 by stitching 16 in a square pattern with an "X" in the middle which gives the union added strength.

The details of the preferred elastic material are visible in FIG. 6. The material is largely open mesh of approximately 80% open area to filaments. A minimum of 50% open area is employed in carrying out this invention with 75% preferred. The longitudinal filaments 17 are elastic Lycra and appear heavier than the transverse filaments are woven between adjacent longitudinals. These transverse filaments are relatively inextensible mono-filament Nylon. Thus the material is elastic in the longitudinal direction by about 50% of its original length. Transversely the material narrows only slightly when longitudinally stretched. Attempts to stretch the fabric transversely encounter virtually no extension. These properties make the material near ideal for this invention.

Referring now specifically to FIG. 6, which is a greatly enlarged view of the elastic material, it is apparent that the structure differs in the longitudinal and transverse directions. The longitudinal filaments 18 are larger and in fact elastic being of Nylon-Lycra material. By way of contrast, the transverse filaments 17 are fine and extend in an undulating path between adjacent longitudinal fibers 18. This undulating path allows for longitudinal extension while maintaining transverse stability with only a minimum degree of lateral dimension change during longitudinal stretching. While the band stretches 50 to 100% longitudinally, it narrows only about 8%. This feature assures broad surface coverage by the band regardless of the size of the film roll.

The above described embodiments of this invention are merely descriptive of its principles and are not to be considered limiting. The scope of this invention instead shall be determined from the scope of the following claims, including thier equivalents.

What is claimed:

1. A film retainer for reel stored film comprising a closed loop of open mesh elastic material being relatively inelastic in a transverse direction and relatively elastic in a longitudinal direction, said elastic material having a maximum extension of at least 50% of its original length for elastic retention of film on a reel.

2. The combination in accordance with claim 1 wherein said closed loop includes a tag secured at one end to said loop and of sufficient length to extend beyond the edge of a reel when said retainer retains a roll of film on a reel.

3. The combination in accordance with claim 1 wherein said retainer is of open mesh having at least 50% open area.

4. The combination in accordance with claim 3 wherein said retainer has an open mesh of at least 75% open area.

5. The combination in accordance with claim 1 wherein said retainer has a transverse dimension approximating the width of film to be retained to provide elastic extension across the full surface of the roll of film.

6. The combination in accordance with claim 4 wherein said material is light in color allowing easy reading of dark labeling on a underlying film leader.

* * * * *